US006513507B2

(12) United States Patent
Balekai et al.

(10) Patent No.: US 6,513,507 B2
(45) Date of Patent: Feb. 4, 2003

(54) INTAKE MANIFOLD MODULE

(75) Inventors: Priyankar S. Balekai, Oak Park, IL (US); Ivana Jojic, Redmond, WA (US)

(73) Assignee: International Engine Intellectual Property Company, L.D.C., Warrenville, IL (US)

( * ) Notice: Subject to any disclaimer, the term of this patent is extended or adjusted under 35 U.S.C. 154(b) by 0 days.

(21) Appl. No.: 09/768,400

(22) Filed: Jan. 24, 2001

(65) Prior Publication Data

US 2002/0023630 A1 Feb. 28, 2002

Related U.S. Application Data

(60) Provisional application No. 60/178,162, filed on Jan. 26, 2000.

(51) Int. Cl.[7] ..... F02M 25/06
(52) U.S. Cl. ..... 123/568.17; 123/568.12
(58) Field of Search ..... 123/568.17, 568.12

(56) References Cited

U.S. PATENT DOCUMENTS

| | | | | | |
|---|---|---|---|---|---|
| 2,977,940 | A | * | 4/1961 | Theriault | 123/568.12 |
| 3,717,131 | A | * | 2/1973 | Chana et al. | 123/568.12 |
| 3,937,196 | A | * | 2/1976 | Cook et al. | 123/568.12 |
| 4,258,687 | A | * | 3/1981 | Mauch et al. | 123/568.12 |
| 4,517,951 | A | * | 5/1985 | Otaka et al. | 123/568.17 |
| 4,693,226 | A | | 9/1987 | Choma | |
| 4,811,697 | A | * | 3/1989 | Kurahashi | 123/568.17 |
| 5,207,714 | A | | 5/1993 | Hayashi et al. | |
| 5,490,488 | A | | 2/1996 | Aversa et al. | |
| 5,785,030 | A | | 7/1998 | Paas | |
| 5,957,116 | A | | 9/1999 | Haegele et al. | |
| 5,979,421 | A | * | 11/1999 | Yamashito et al. | 123/568.12 |
| 6,039,033 | A | | 3/2000 | Kim et al. | |
| 6,073,617 | A | | 6/2000 | Busato et al. | |
| 6,152,115 | A | | 11/2000 | Busato et al. | |
| 6,205,785 | B1 | | 3/2001 | Coleman | |
| 6,216,458 | B1 | | 4/2001 | Alger et al. | |

* cited by examiner

*Primary Examiner*—Paul J. Hirsch
(74) *Attorney, Agent, or Firm*—Dennis Kelly Sullivan; Jeffrey P. Calfa; Neil T. Powell

(57) ABSTRACT

There is provided an intake manifold module that integrates an intake air manifold with an exhaust gas recirculation system resulting in a compact design that optimizes vehicle engine compartment space, and results in reduced engine manufacturing time and cost. The intake manifold module comprises an integrally cast intake air manifold having an EGR valve aperture, an EGR cooler mounting, an EGR gas-out passage, and an EGR coolant-out; an EGR valve operatively mounted in the EGR valve aperture, and an EGR cooler cooperatively attached to the intake air manifold. Further, the EGR cooler comprises a gas outlet attached to the EGR gas-out passage, an exhaust gas inlet, a coolant inlet passage, a coolant outlet attached to the EGR coolant-out passage, and an EGR cooler mounting bracket. In operation, exhaust gases enter the EGR cooler, are cooled by EGR coolant, pass through the EGR valve and into the intake manifold.

20 Claims, 9 Drawing Sheets

EGR WATER OUTLET HOSE
INSTALLED TO FRONT COVER

EGR GAS IN TUBE
INSTALLED

INSTALLING EGR VALVE

ASSEMBLING EGR COOLER TO INTAKE MANIFOLD

V8 INTAKE MANIFOLD
(TOP VIEW)

V8 INTAKE MANIFOLD
(BOTTOM VIEW)

V6 INTAKE MANIFOLD

V6 INTAKE MANIFOLD

V6 INTAKE MANIFOLD MODULE

INTAKE MANIFOLD MODULE

This patent application claims the benefit of Provisional U.S. Patent application Serial No. 60/178,162 filed on Jan. 26, 2000.

FIELD OF THE INVENTION

This invention relates generally to intake air manifolds for internal combustion engines. More particularly, this invention relates to intake air manifolds integrating an exhaust gas recirculation (EGR) system for a diesel engine.

BACKGROUND OF THE INVENTION

The use of exhaust gas recirculation (EGR) systems in internal combustion engines is well known. A typical EGR system takes a fraction of the exhaust gases from the exhaust manifold and injects it into the intake air for the engine where it is mixed with fresh air and fuel and then reburned. Mixing exhaust gases with fresh intake air and fuel lowers peak combustion temperatures thereby reducing formation rates of oxides of nitrogen in the exhaust gas. The use of an EGR system for the injection of exhaust gases into the intake air requires a plurality of separate components. The separate components can pose a problem since the space available in vehicle engine compartments is typically limited. Further, the additional components increase the complexity and time required to assemble the engine and can also increase the size of the engine.

Accordingly, there is a need for an intake air manifold integrated with an exhaust gas recirculation system.

SUMMARY OF THE INVENTION

The present invention provides an integrated intake manifold module that combines an intake air manifold with an exhaust gas recirculation (EGR) system, resulting in a novel and compact design that will optimize the limited space available in a vehicle engine compartment. The intake manifold module is comprised of an intake air manifold having an EGR valve aperture, an EGR cooler mounting, and an intake/EGR gas passage. There is also an EGR valve operatively mounted in the EGR valve aperture, and an EGR cooler cooperatively attached to the intake air manifold. The EGR cooler is between the intake air manifold and a top area of an engine block. Further, the EGR cooler comprises a gas outlet cooperatively attached to the intake/EGR gas passage, an exhaust gas inlet, a coolant inlet passage, a coolant outlet passage, and an EGR cooler mounting bracket cooperatively attached to the EGR cooler mounting. In operation, exhaust gases enter the EGR cooler through the EGR gas inlet. Coolant passes through the EGR cooler to cool the exhaust gases. The exhaust gases then pass through the EGR valve into the intake air manifold, where they mix with the intake air.

The intake manifold module advantageously integrates EGR system components, e.g., EGR valve, EGR gas outlet, and EGR coolant outlet, into the intake manifold via the use of casting cores without performance compromise. The intake manifold module has a compact design that reduces the number of fastening and sealing components (bolts, clamps, O-Rings, gaskets, etc). This minimizes the total number of components and sealing connections. This level of integration minimizes the assembly time and cost, and warranty costs while maintaining serviceability of the EGR valve and EGR cooler. In addition, this intake manifold module puts the EGR injection point in the intake manifold, closer to the engine cylinders. This improves engine performance by shortening the response and purge time of the system without impeding mixing and distribution of EGR gases in the manifold.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DESCRIPTION OF THE INVENTION

The intake manifold module of the present invention will minimize the number of components and sealing connection in the EGR system and result in reduced engine manufacturing time and manufacturing cost.

Figure 1:
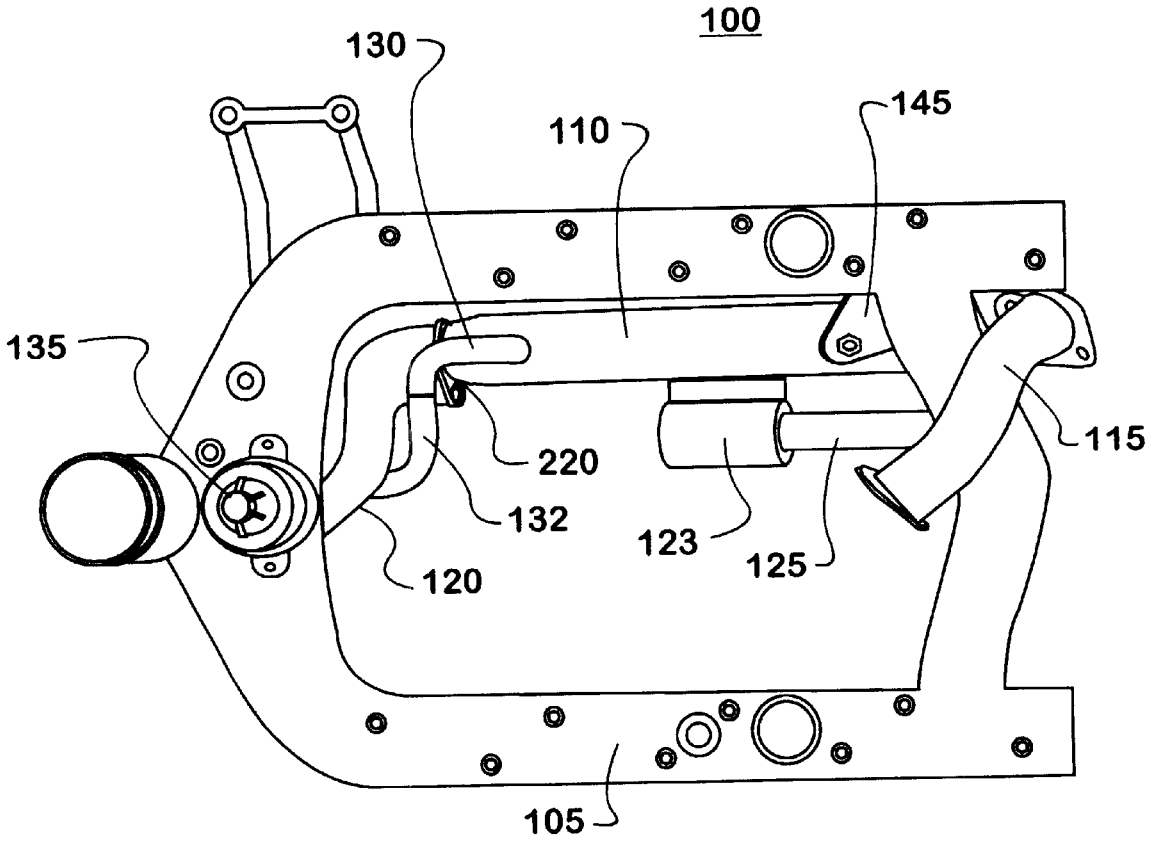
FIG. 1 shows a first embodiment of the intake manifold module according to the present invention.

FIG. 1 shows an embodiment of the intake manifold module 100 that integrates an intake air manifold with an exhaust gas recirculation (EGR) system according to the present invention. There is shown an intake air manifold 105 operatively connected to an exhaust gas recirculation (EGR) cooler 110 via an intake/EGR gas passage 120, and an EGR valve 135 at a top portion 605 (shown in FIG. 6). In the embodiment of FIG. 1, the intake manifold module 100 preferably has the oil cooler 110 located between a top area of an engine (not shown) and the intake air manifold 105. This component position configuration is intended to optimally use the limited engine space available in a vehicle engine compartment. However, those of skill in the art will recognize that the EGR oil cooler 110 position could also be adjacent to the intake air manifold 105.

Figure 2:
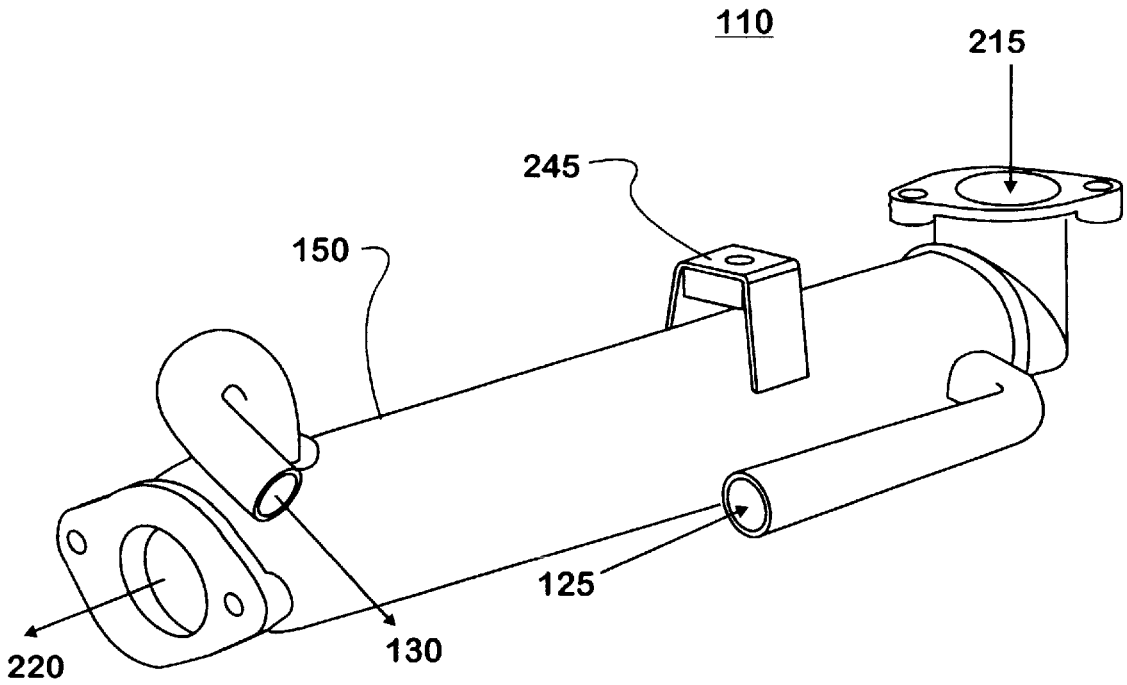
FIG. 2 shows an EGR cooler for the intake manifold module of FIG. 1

FIG. 1 shows an EGR gas Inlet tube 115 attached to an EGR gas inlet 215 (shown in FIG. 2). The EGR gas inlet tube 115 provides a passage for the exhaust gas between an exhaust manifold (not shown) and the EGR gas inlet 215. The EGR gas Inlet tube 115 Is preferably a flexible type metal tubing (shown in FIG. 5), However, the EGR gas inlet tube can also be a rigid tube or other tube material that can act as a passage for the exhaust gas to the EGR cooler 110.

On the opposite side of the EGR cooler 110 is shown an EGR gas-out passage 120 attached to the EGR gas outlet 220 (also shown in FIG. 2). The EGR gas-out passage 120 connects the EGR cooler 110 to the intake air manifold 105. The EGR gas-out passage 120 provides a passage for the cooled exhaust gas to the intake air manifold 105 from the EGR gas outlet 220, via the EGR valve 135. The EGR gas-out passage 120 is preferably cast as part of the intake air manifold 105. However, those of skill in the art will readily recognize that the EGR gas-out passage 120 could also be a separate piece, or a part of the EGR cooler 110. Further, the EGR gas-out passage 120 could also be a rigid or flexible passage that connects the intake air manifold 105 and the EGR cooler 110.

FIG. 1 also shows an EGR cooler mounting 145. The EGR cooler mounting 145 allows the EGR cooler 110 to be mounted, via an EGR cooler mounting bracket 245 (shown in FIG. 2), to the intake air manifold 105, e.g., via a simple screw. Again, those of skill in the art will readily recognize that mounting or fastening of the EGR cooler bracket 245 to the EGR cooler mounting 145 could be by other well know methods, e.g., a bolt and nut connection, a welded connection, rivet connection, compression type connection, etc. There is also shown an EGR coolant inlet passage 125 attached to a inlet coupling assembly 123 which will allow coolant to flow into the EGR cooler 110. The coolant will then flow out of the EGR cooler 110 through a coolant outlet passage 130 and onto a front cover 405 (shown in FIG. 4), via an EGR outlet hose 132.

FIG. 2 shows an embodiment of the EGR cooler 110 for the intake manifold module 100 of FIG. 1. The EGR cooler 110 has a gas inlet and outlet 215 and 220, a coolant inlet and outlet passage 125 and 130 and a mounting bracket 245 attached to an exterior of the EGR cooler body 150. The EGR bracket 245 will enable the EGR cooler to be mounted to the intake air manifold 105, via the EGR cooler mounting 145. The location of the EGR bracket 245 on the EGR cooler 110 is such that the EGR cooler 110 can be attached to a rear portion of the intake air manifold 105. In operation, exhaust gases pass through the EGR cooler 110. Coolant, e.g., cooling water, cools the exhaust gases that then enter the intake air manifold 105 through appropriate operation of the EGR valve 135.

The EGR cooler 110 is preferably made of 304 stainless steel although other suitable materials may be used. The EGR cooler 110 is designed to keep the temperature of the exhaust gases entering the intake air manifold preferably in the range of about 280° F. to 650° F. Those of skill in the art will recognize that this range may vary depending on the particular engine application involved.

On the inside, the EGR cooler body 150 preferably has a 37-tube bundle (not shown) forming a tubular heat exchanger. The number of tube bundles can vary depending on the temperature range desired and the type of engine being used. The tubes keep the coolant, e.g., cooling water, separate from the exhaust gases. As shown, the EGR cooler 110 is preferably a concurrent flow heat exchanger. However, other types of heat exchangers may be used, such as a counter-flow heat exchanger.

In a preferred embodiment, the cooler body 150 has a length in the range of about of 254 mm to 346 mm depending upon the type of engine. The EGR gas inlet 215 has a diameter of 35 mm. The EGR gas outlet 220 has a diameter of 30 mm. The EGR coolant inlet 125 and EGR coolant outlet 130 have a 19 mm outside diameter with a 1 mm wall thickness. Those of skill in the art will readily recognize that other dimensions may be used depending on the particular engine application.

Figure 3:
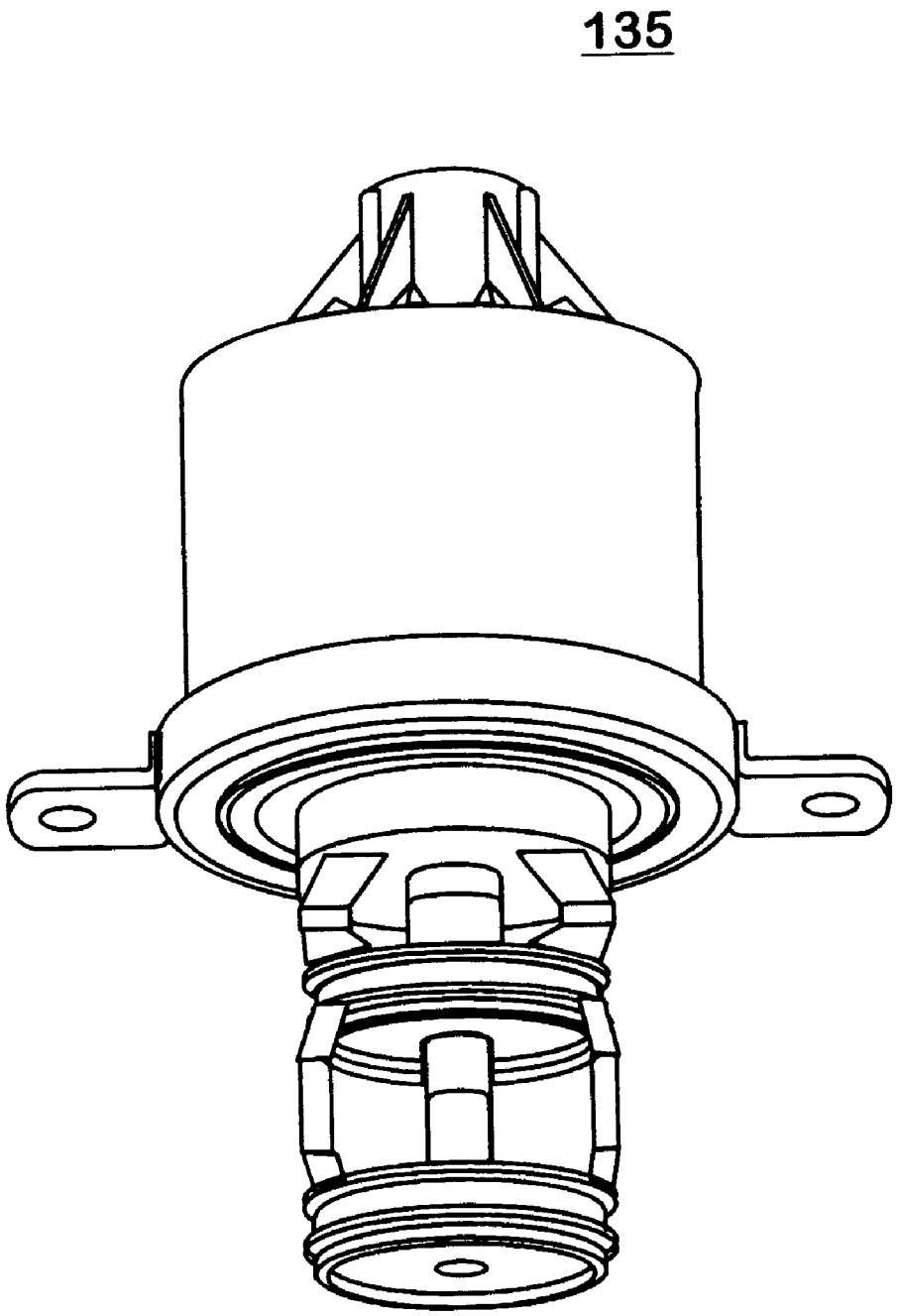
FIG. 3 shows an EGR valve for the intake manifold module of FIG. 1.

FIG. 3 shows a typical EGR valve 135 used in the intake manifold module 100 of the present invention. The EGR valve 135 is an electronic proportional valve with a balanced dual poppet. The EGR valve 135 is preferably made of stainless steel with a trivalent chromate actuator housing. The EGR valve 135 includes an integral feedback position sensor and a cartridge design for easy integration in the intake manifold module 100. The EGR valve 135 has a closing time that is less than 50 msec. The EGR valve 135 is controlled by an EGR controller or other microprocessor (e.g., an electronic control module). While a particular valve has been described, other suitable valves may be used with the intake manifold module 100.

Figure 4:
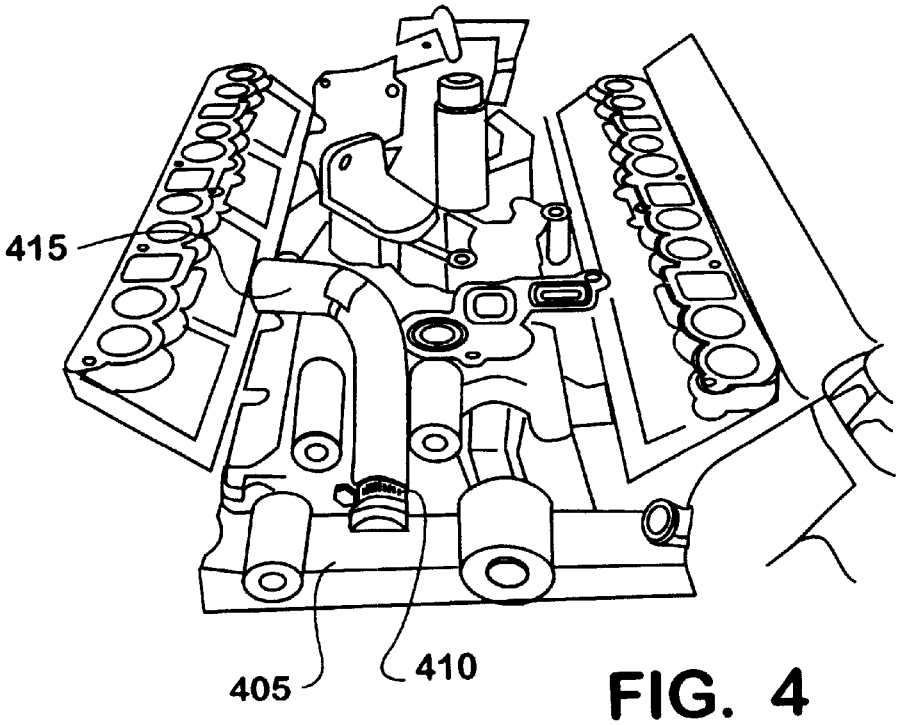
FIG. 4 shows an EGR cooler outlet hose for the intake manifold module of FIG. 1.

FIG. 4 shows the EGR outlet hose 132 for the EGR cooler 110. The EGR outlet hose 132 is shown attached, on one end 410, to the front cover 405 of the engine. The opposite end 415 of the EGR outlet hose 132 will be attached to the EGR coolant outlet passage 130 when the intake manifold module 100 is installed (as shown in FIG. 1).

Figure 5:
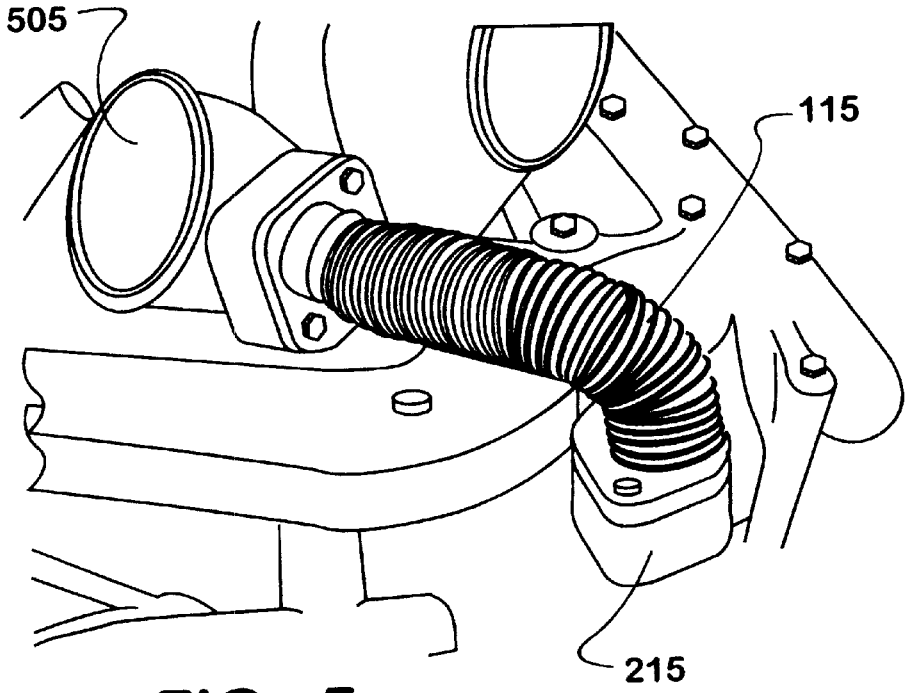
FIG. 5 shows an exhaust gas tube connected to the EGR gas inlet for the intake manifold module of FIG. 1.
Figure 6:
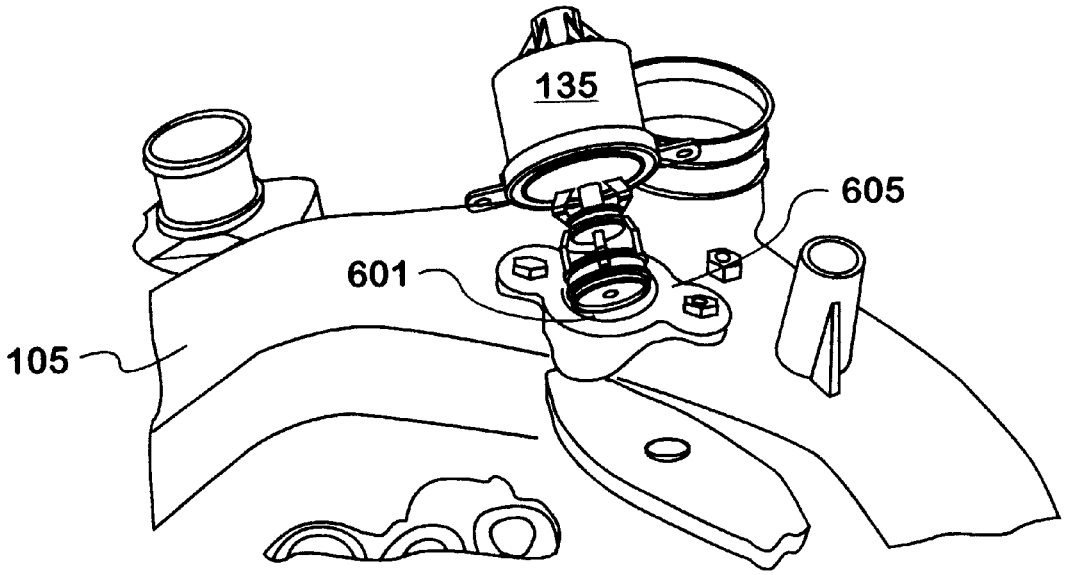
FIG. 6 shows a partially installed EGR valve for the intake manifold module of FIG. 1.
Figure 7:
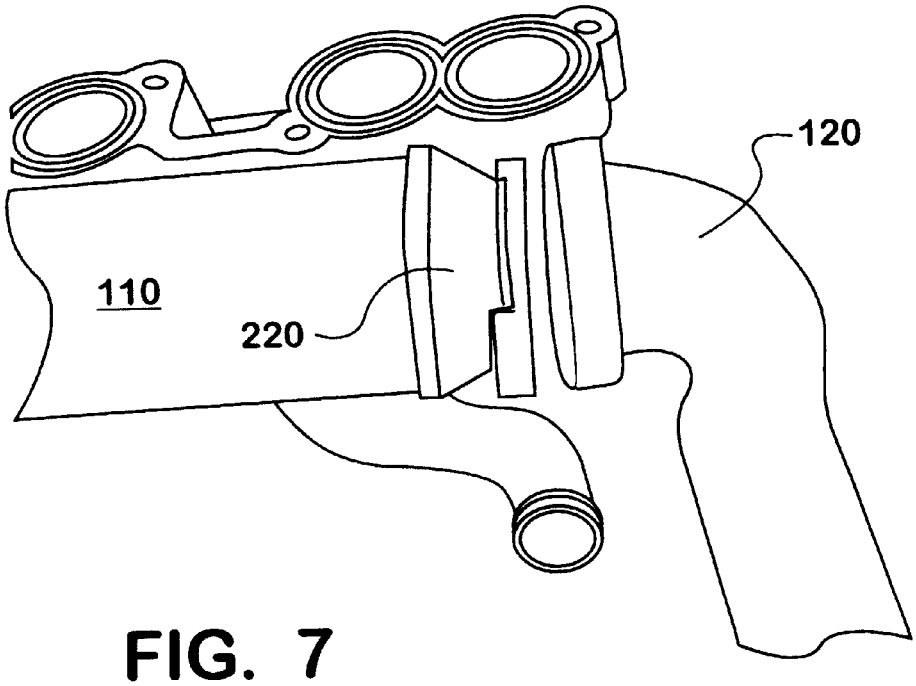
FIG. 7 shows an incomplete connection between the EGR cooler and the intake manifold for the intake manifold module of FIG. 1.

FIG. 5 shows the EGR gas inlet tube 115 connecting the EGR gas inlet 215 of the intake manifold module 100 and the exhaust manifold 505. FIG. 6 shows the EGR valve 135 partially installed in EGR aperture 601 in a top portion 605 of the intake air manifold 105. FIG. 7 shows the EGR cooler 110 gas outlet 220 and the intake manifold /EGR passage 120 of the intake manifold 105 as partially connected. FIG. 7 also shows the EGR coolant outlet passage 130.

Figure 8A:
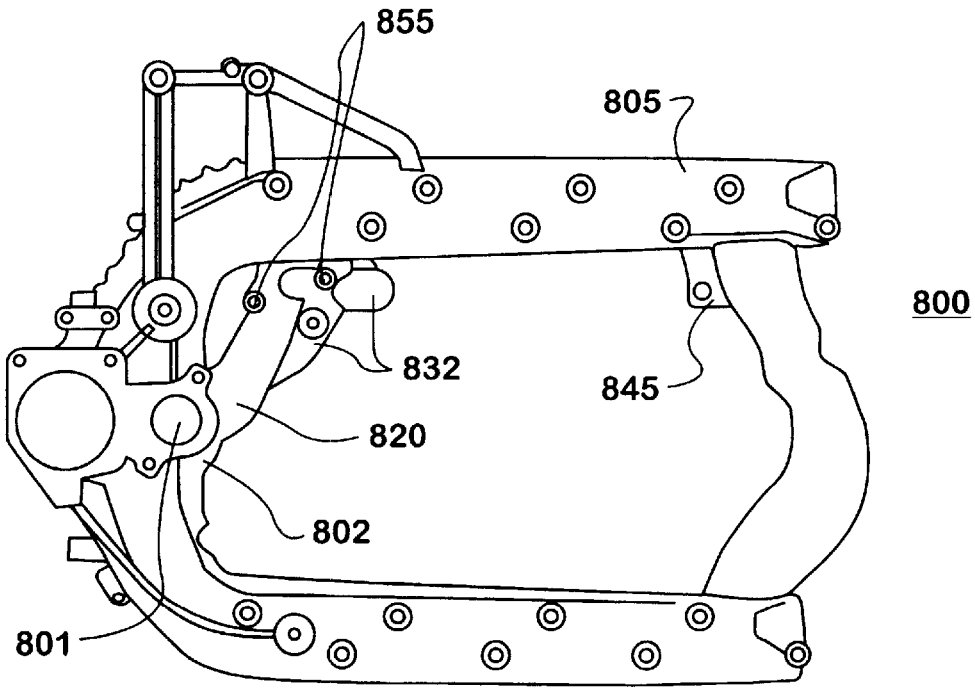
FIG. 8*a* shows a top view of a second embodiment of the intake manifold module according to the present invention.

FIG. 8*a* shows a top view of a second embodiment of the intake manifold module according to the present invention. The second embodiment 800 of the intake manifold module is similar to the first embodiment 100 of FIG. 1. The main difference is that the intake manifold module 800 of FIG. 8*a* preferably further comprises an EGR coolant-out passage 832 that is cast with the intake manifold 805 adjacent to the EGR gas-out passage 820. Also, the intake manifold module of FIG. 8*a* is preferably used for an engine with a V-8 type configuration. Those of skill in the art will readily recognize that the module can be modified for other engine types.

FIG. 8*a* shows an integrated intake manifold module 800. There is shown an air intake manifold 805 with an EGR aperture 801 in a top portion 802 of the intake air manifold 805. As before, an EGR valve will preferably be installed in the EGR aperture 801. There are also shown EGR cooler mountings 845 and 855. The EGR cooler mountings 845 and 855 allow the EGR cooler 1110 (shown in FIG. 11) to be mounted, via an EGR cooler mounting brackets 1145 and 1155 (shown in FIG. 11), to the intake air manifold 805, e.g., via a simple screw. Again, those of skill in the art will readily recognize that mounting or fastening of the EGR cooler brackets 1145 and 1155 to the EGR cooler mountings 845 and 855 can be by other well know methods, e.g., a bolt and nut connection, a welded connection, rivet connection, compression type connection, etc.

There is shown an EGR gas-out passage 820 and an EGR coolant-out passage 832 preferably adjacent to each other. The EGR gas-out passage 820 connects an EGR cooler 1110 to the intake air manifold 805. The EGR gas-out passage 820 provides a passage for the cooled exhaust gas to the intake air manifold 805 from the EGR cooler gas outlet 1120 (shown in FIG. 11), via the EGR valve 135. The EGR gas-out passage 820 is preferably cast as part of the intake air manifold 805. The EGR coolant-out passage 832 connects the EGR cooler 1110 to the front module 405 (shown in FIG. 4). The EGR coolant-out passage 832 provides a passage for the EGR coolant from the EGR coolant outlet 1130 to the front module 405. Thus, in the second embodiment of the intake manifold module 805, the EGR coolant-out passage 832 essentially replaces the EGR coolant outlet hose 132 (shown in FIGS. 1 and 4). Further, the EGR coolant-out passage 832 is preferably cast as part of the intake air manifold 805 and adjacent to the EGR gas-out passage 820.

Figure 8B:
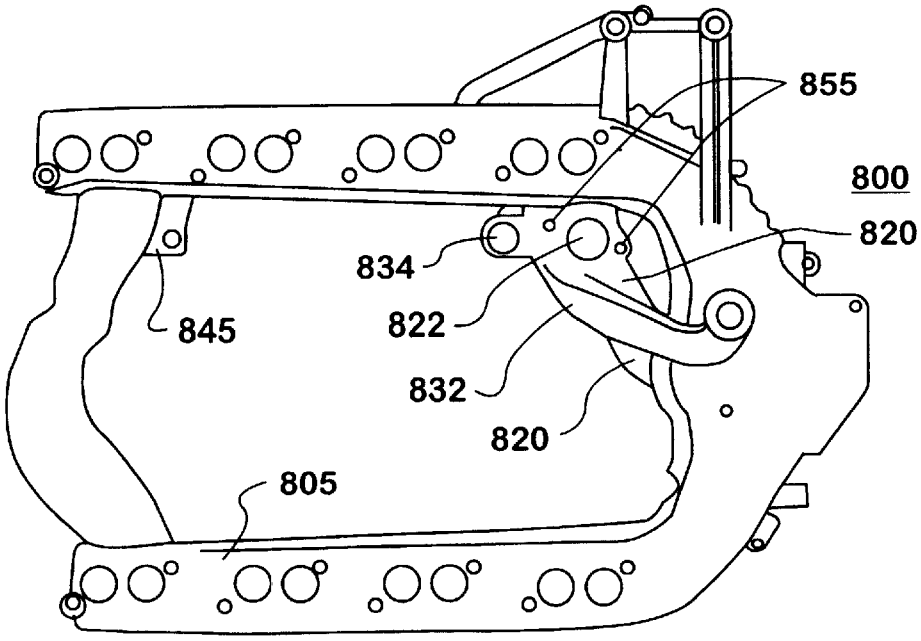
FIG. 8*b* shows a bottom view of the second embodiment of the intake manifold module shown in FIG. 8*a;*

FIG. 8*b* shows a bottom view of the second embodiment of the intake manifold module shown in FIG. 8*a*. There is shown the EGR cooler mountings 845 and 855. There is also shown a bottom view of the EGR gas-out passage 820 and an EGR coolant-out passage 832 which are preferably adjacent to each other and cast as past of the intake air manifold 805. FIG. 8*b* shows the gas inlet 822 to the EGR gas-out passage 820. FIG. 8*b* also shows the coolant inlet 834 and coolant outlet 836 of the EGR coolant-out passage 832.

Figure 9A:
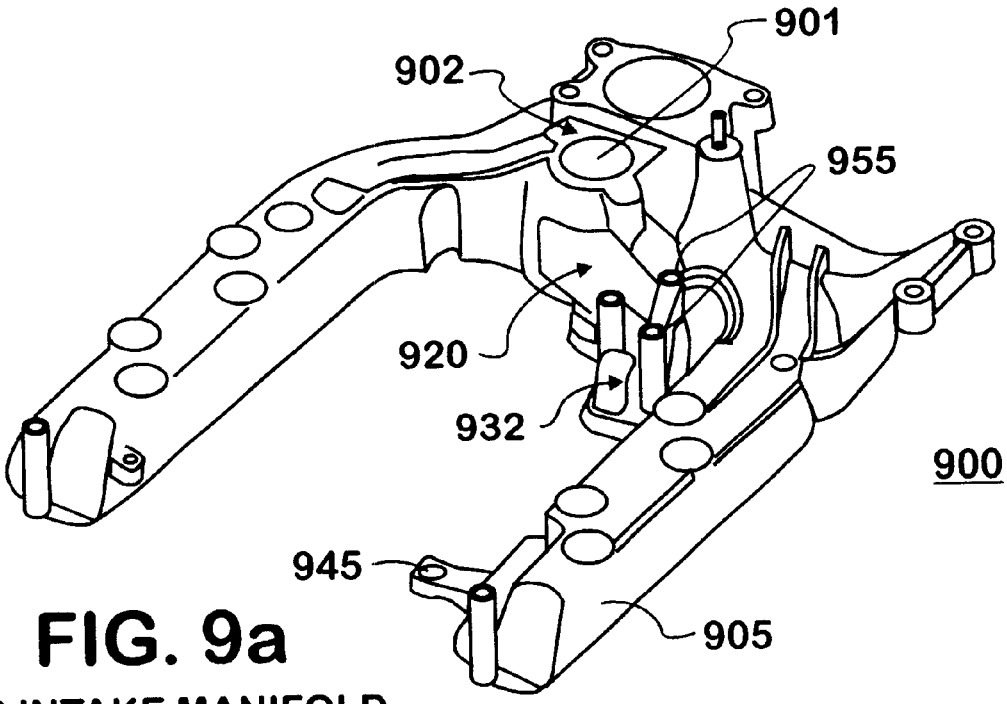
FIG. 9*a* shows a top perspective view of a third embodiment of the intake manifold module according to the present invention.

FIG. 9*a* shows a top perspective view of a third embodiment of the intake manifold module 900 according to the present invention. The third embodiment 900 of the intake manifold module is similar to the second embodiment 800 of FIGS. 8*a* and 8*b*. The intake manifold module of FIG. 9*a*, however, is preferably used for an engine with a V-6 type configuration. Those of skill in the art will readily recognize that the module can be modified for other engine types.

FIG. 9*a* shows an integrated intake manifold module 900. There is shown an air intake manifold 905 with an EGR aperture 901 in a top portion 902 of the intake air manifold 905. As before, an EGR valve will preferably be installed in the EGR aperture 901. There are also shown EGR cooler mountings 945 and 955. The EGR cooler mountings 945 and 955 allow the EGR cooler 1010 and 1110 (shown in FIGS. 10 and 11) to be mounted, via an EGR cooler mounting brackets 1045, 1145 and 1155 (shown in FIGS. 10 and 11), to the intake air manifold 905, e.g., via a simple screw. Those of skill in the art will readily recognize that mounting or fastening of the EGR cooler brackets 1045, 1145 and 1155 to the EGR cooler mountings 945 and 955 could be by other well know methods, e.g., a bolt and nut connection, a welded connection, rivet connection, compression type connection, etc.

There is also shown an EGR gas-out passage 920 and an EGR coolant-out passage 932 preferably adjacent to each other. The EGR gas-out passage 920 connects the EGR cooler 1010 and 1110 to the intake air manifold 905. The EGR gas-out passage 920 provides a passage for the cooled exhaust gas to the intake air manifold 905 from the EGR cooler gas outlet 1120 (shown in FIG. 11), via the EGR valve 135. The EGR gas-out passage 920 is preferably cast as part of the intake air manifold 905. The EGR coolant-out passage 932 connects the EGR cooler 1010 and 1110 to the front module 405 (shown in FIG. 4). The EGR coolant-out passage 932 provides a passage for the EGR coolant from the EGR coolant outlet 1130 to the front module 405. Thus, in this second embodiment of the intake manifold module 905, the EGR coolant-out passage 932 essentially replaces the EGR coolant outlet hose 132 (shown in FIGS. 1 and 4). Further, the EGR coolant-out passage 932 is preferably cast as part of the intake air manifold 905 and adjacent to the EGR gas-out passage 820.

Figure 9B:
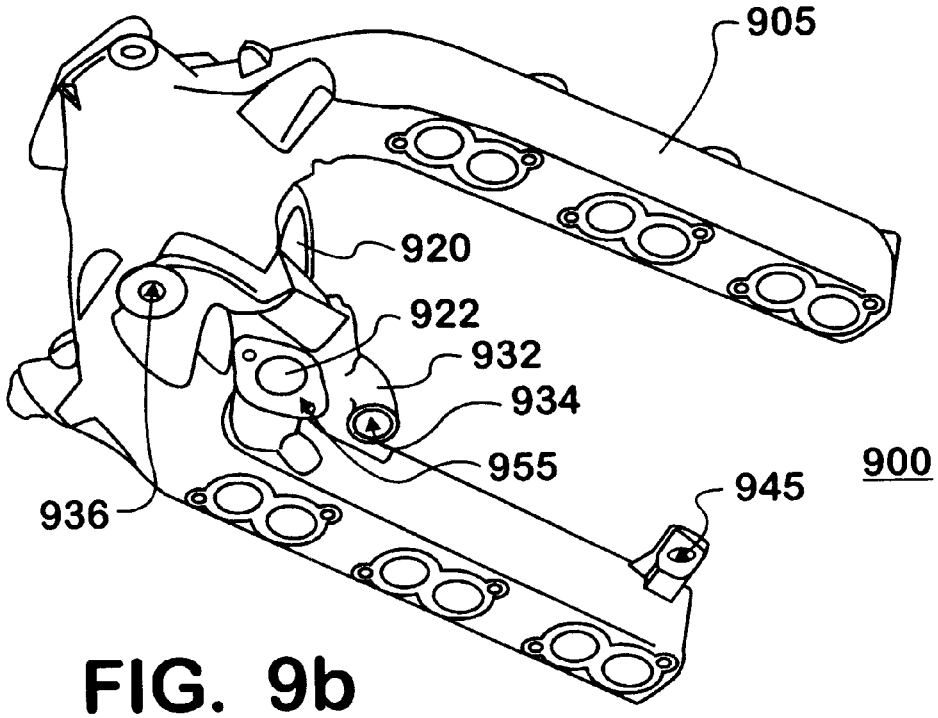
FIG. 9*b* shows a bottom perspective view of the third embodiment of the intake manifold module shown in FIG. 9*a;*

FIG. 9*b* shows a bottom perspective view of the third embodiment of the intake manifold module shown in FIG. 9*a*. There is shown the EGR cooler mountings 945 and 955. There is also shown a bottom view of the EGR gas-out passage 920 and the EGR coolant-out passage 932 which are preferably adjacent to each other and cast as past of the intake air manifold 905. FIG. 9*b* shows the gas inlet 922 to the EGR gas-out passage 920. FIG. 9*b* also shows the coolant inlet 934 and coolant outlet 936 of the EGR coolant-out passage 932.

Figure 10:
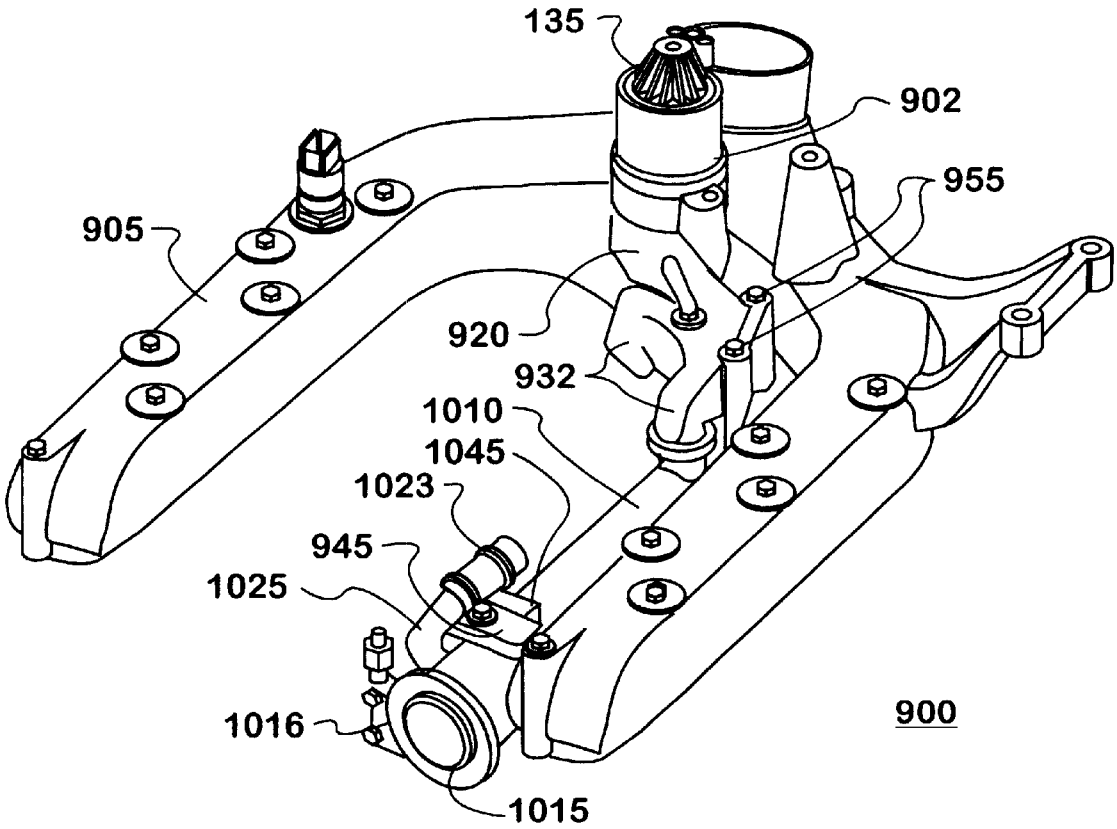
FIG. 10 shows a top perspective view of the third embodiment of the intake manifold module shown in FIG. 9*b* with an EGR cooler attached thereto.

FIG. 10 shows a top perspective view of the third embodiment of the intake manifold module 905 shown in FIG. 9*a* with an EGR cooler 1010 attached thereto. There is shown the air intake manifold 905 with the EGR valve 135 cooperatively installed in the top portion 902 of the intake air manifold 905. There is shown the EGR cooler 1010 attached to the EGR gas-out passage 920 and EGR coolant-out passage 932. There is also shown the EGR cooler 1010 attached to the intake air manifold 905 mountings 945 and 955 via the EGR cooler mounting brackets 1045, 1145 and 1155 (shown in FIG. 11) via simple screws. Those of skill in the art will recognize that other mounting means can be used. Last, FIG. 10 also shows the EGR cooler gas inlet 1015 and coolant inlet 1025, along with a cooler gas inlet clamp 1016 and an inlet coupling assembly 1023 and 1123. The EGR gas inlet 1015 is the passage for exhaust gas from the exhaust manifold (not shown). The inlet coupling assembly 1223 allows coolant to flow into the EGR cooler 1010.

Figure 11:
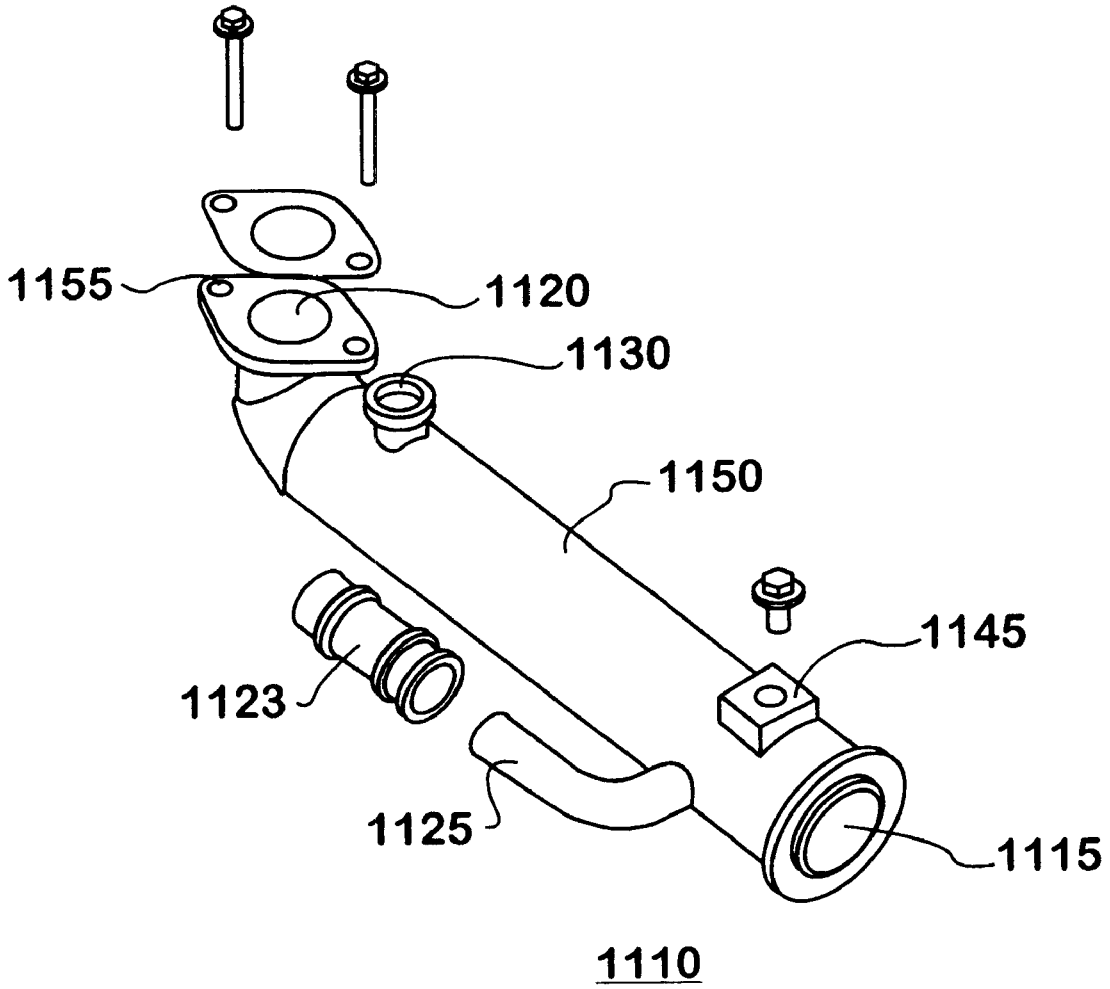
FIG. 11 shows a second embodiment of the EGR cooler for the intake manifold module.

FIG. 11 shows a second embodiment of the EGR cooler 1110 for the intake manifold module that could preferably be used with the intake manifold modules 800 and 900 shown in FIGS. 8*a*, 9*b* and 10. The EGR cooler 1110 has a gas inlet and outlet 1115 and 1120, a coolant inlet and outlet passage 1125 and 1130 and mounting brackets 1145 and 1155 attached to an exterior of the EGR cooler body 1150. The EGR cooler 1110 shown here is similar to the EGR cooler 110 shown in FIG. 2. However, the EGR cooler 1110 of the present embodiment differs in the configuration of the EGR cooler gas outlet 1120 and the EGR cooler coolant outlet 1130. The modified configuration of the EGR cooler 1110 will allow appropriate connection with the EGR gas-out passage 820 and 920 and the EGR coolant-out passage 832 and 932 of the intake air manifold 805 and 905 of the second 800 and third 900 embodiments of the intake manifold module (shown in FIGS. 8*a*, 9*a* and 10).

The EGR brackets 1145 and 1155 will enable the EGR cooler to be mounted to the intake air manifold 805 and 905, via the EGR cooler mountings 845, 855, 945 and 955. The location of the EGR brackets 1145 and 155 on the EGR cooler 1110 is such that the EGR cooler 1110 can be appropriately attached to the intake air manifold 805 and 905. In operation, exhaust gases pass through the EGR cooler 1110. Coolant cools the exhaust gases. The cooled exhaust gasses then enter the EGR gas-out passage 820 and 920 and then enter the intake air manifold 805 and 905 through appropriate operation of the EGR valve 135. The coolant exits the EGR cooler 1110 via the coolant outlet 1130 and then enters the EGR coolant-out passage 832 and 932 and proceeds to the front module 405.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

We claim:

1. An intake manifold module for an internal combustion engine comprising:

an intake manifold comprising an EGR valve aperture;

an EGR valve operatively mounted in the EGR valve aperture, wherein a valve operator of the EGR valve is disposed within the intake manifold and controls, from within the intake manifold, whether exhaust gas from an EGR gas-out passage enters into the intake manifold; and an EGR cooler cooperatively attached to the intake manifold.

2. The intake manifold module of claim 1, wherein the EGR gas-out passage is integrated into the intake manifold.

3. The intake manifold module of claim 2, wherein the intake manifold further comprises an EGR coolant-out passage.

4. The intake manifold module of claim 3, wherein the intake manifold is integrally cast as a single piece.

5. The intake manifold module of claim 1, wherein the EGR cooler comprises a gas outlet cooperatively attached to the EGR gas-out passage, a gas inlet, a coolant inlet passage, a coolant outlet passage, and an EGR cooler mounting bracket cooperatively attached to an EGR cooler mounting disposed on the intake manifold.

6. The intake manifold module of claim 1, wherein the intake manifold has at least two legs, and wherein the EGR cooler is is disposed near one of the two legs of the intake manifold.

7. The intake manifold module of claim 5, wherein the EGR gas inlet tube is a rigid tube, or a flexible tube.

8. The intake manifold module of claim 1, wherein the exhaust gas passes from a gas inlet to the EGR cooler and through the EGR cooler via a single pass to the EGR gas-out passage.

9. The intake manifold module of claim 1, wherein the EGR valve aperture is in a top portion of the intake manifold.

10. The intake manifold module of claim 1, wherein the EGR gas-out passage is a separate piece.

11. The intake manifold module of claim 1, further comprising an EGR coolant-out passage that is a separate piece.

12. The intake manifold module of claim 1, wherein exhaust gas enters the intake manifold from the EGR gas-out passage when the valve operator is in a first position and exhaust gas is prevented from entering the intake manifold from the EGR gas-out passage when the valve operator is in a second position.

13. An intake manifold module for an internal combustion engine comprising:

an intake air manifold comprising an EGR valve aperture, an EGR gas-out passage, and an EGR coolant-out passage;

an EGR valve operatively mounted in the EGR valve aperture, wherein a valve operator of the EGR valve is disposed within the intake manifold; and an EGR cooler cooperatively attached to the intake air manifold, the EGR cooler comprising a gas outlet cooperatively attached to the EGR gas-out passage, a gas inlet, a coolant inlet passage, a coolant outlet cooperatively attached to the EGR coolant-out passage.

14. The intake manifold module of claim 13, wherein the EGR gas inlet tube is a rigid tube, or a flexible tube.

15. The intake manifold module of claim 13, wherein the exhaust gas passes from a gas inlet to the EGR cooler and through the EGR cooler via a single pass to the EGR gas-out passage.

16. The intake manifold module of claim 13, wherein the EGR valve aperture is in a top portion of the intake manifold.

17. The intake manifold module of claim 13, wherein the intake manifold is integrally cast as a single piece.

18. The intake manifold module of claim 13, wherein the intake air manifold further comprises an EGR cooler mounting and wherein an EGR cooler mounting bracket disposed on the EGR cooler is cooperatively attached to the EGR cooler mounting.

19. The intake manifold module of claim 13, wherein the intake manifold has at least two legs, and wherein the EGR cooler is disposed near one of the two legs of the intake manifold.

20. The intake manifold module of claim 13, wherein exhaust gas enters the intake manifold from the EGR gas-out passage when the valve operator is in a first position and exhaust gas is prevented from entering the intake manifold from the EGR gas-out passage when the valve operator is not in the first position.

* * * * *